US009487929B2

(12) United States Patent
Wei et al.

(10) Patent No.: US 9,487,929 B2
(45) Date of Patent: Nov. 8, 2016

(54) SYSTEMS AND METHODS FOR ADJUSTING PASS DEPTH IN VIEW OF EXCESS MATERIALS

(71) Applicant: Caterpillar Inc., Peoria, IL (US)

(72) Inventors: Mo Wei, Dunlap, IL (US); Michael Taylor, Swissvale, PA (US); Thandava Edara, Peoria, IL (US)

(73) Assignee: Caterpillar Inc., Peoria, IL (US)

( * ) Notice: Subject to any disclaimer, the term of this patent is extended or adjusted under 35 U.S.C. 154(b) by 0 days.

(21) Appl. No.: 14/639,459

(22) Filed: Mar. 5, 2015

(65) Prior Publication Data

US 2016/0258129 A1 Sep. 8, 2016

(51) Int. Cl.
*E02F 3/84* (2006.01)
*E02F 9/20* (2006.01)

(52) U.S. Cl.
CPC ..... *E02F 3/844* (2013.01); *E02F 9/2029* (2013.01)

(58) Field of Classification Search
CPC ... G05D 1/0278; G05D 1/0236; E02F 3/844; E02F 9/2045; E02F 3/841; E02F 3/437; F41H 7/005; B09B 1/00
USPC ..... 701/26, 50, 2; 37/414; 700/245, 259; 702/5
See application file for complete search history.

(56) References Cited

U.S. PATENT DOCUMENTS 6,108,949 A * 8/2000 Singh ..... E02F 3/437 37/195
7,509,198 B2 3/2009 Shull et al.
8,620,535 B2 12/2013 Friend et al.
8,639,393 B2 1/2014 Taylor et al.
2004/0158355 A1* 8/2004 Holmqvist ..... G05D 1/0236 700/245
2007/0129869 A1 6/2007 Gudat et al.
2007/0299590 A1* 12/2007 Shull ..... E02F 3/841 701/50
2010/0179691 A1* 7/2010 Gal ..... F41H 7/005 700/259
2012/0136508 A1* 5/2012 Taylor ..... E02F 9/2045 701/2
2013/0144528 A1* 6/2013 Williams ..... B09B 1/00 702/5
2013/0311031 A1* 11/2013 Friend ..... G05D 1/0278 701/26
2014/0257646 A1* 9/2014 Ishibashi ..... E02F 3/844 701/50

* cited by examiner

*Primary Examiner* — Yuri Kan
(74) *Attorney, Agent, or Firm* — Miller, Matthias & Hull LLP

(57) ABSTRACT

A method for controlling an earthmoving machine and a work implement associated with the earth moving machine is disclosed. The method includes receiving positioning signals from a positioning system associated with the earthmoving machine, the positioning signals indicative of a topography of the work surface. The method further includes determining a profile of the work surface based on the positioning signals and determining if the profile of the work surface includes a bump, the bump having a bump height which is greater than an expected surface height. The method further includes determining a depth adjustment based on the bump height and adjusting the target depth based on the depth adjustment, if the profile of the work surface includes the bump.

20 Claims, 5 Drawing Sheets

SYSTEMS AND METHODS FOR ADJUSTING PASS DEPTH IN VIEW OF EXCESS MATERIALS

TECHNICAL FIELD

The present disclosure generally relates to control systems for earthmoving machines and, more particularly, relates to systems and methods for controlling earthmoving machines to adjust depth of passes based on the presence of excess materials above an expected height of a work surface.

BACKGROUND

Earthmoving machines, such as bulldozers, may be used to move materials at a work site. Such machines may operate in an autonomous or semi-autonomous manner to perform ground moving tasks in response to commands generated as part of a work plan for the machine. The machine may receive instructions based on such a work plan to perform operations (e.g., cutting, digging, loosening, carrying, etc.) at the worksite.

If such a machine operates autonomously, it may remain consistently productive without needing manual operation. Autonomous control systems may also allow for operation in work sites or environments which may be unsuitable or undesirable for a human operator. Further, autonomous and semi-autonomous systems may also compensate for inexperienced human operators and inefficiencies associated with repetitive ground moving tasks.

Control of ground moving machines and their associated work tools or implements is often developed by an on-board or off-board control system. Conditions associated with work sites, operation environment, and/or the machine itself may affect operation of the control system. Also, such conditions may have an effect on the overall efficiency of the machine or its associated work cycle. It is beneficial to determine such conditions and manage the control of earthmoving machines to ensure that material moving operations are performed in an efficient manner. Similarly, the locations at which earthmoving machines alter surfaces of a work site, and/or the profiles along which the machines alter the surfaces, should be chosen such that the machine functions efficiently.

In some working situations, the work surface has an expected height, at which the earthmoving machine may make an initial cut or pass and plan the depth of the pass based on the expected height. Some past control systems employing automated excavation planning like, for example, U.S. Pat. No. 8,620,535 ("System for Automated Excavation Planning and Control") include schemes for adjusting excavation plans based on a missed volume from a pass.

However, even with the adjustments made in prior systems, bumps above an expected height may be present and not accounted for. Such bumps may not be factored into the initial pass calculation and, therefore, may cause the calculated pass to include a volume of materials to be pushed that is too large for the earthmoving machine to handle. If the volume of materials is too large for the earthmoving machine to handle, the materials may not be adequately cleared and/or the earthmoving machine may enter a stall condition when the weight and/or volume of the materials are beyond material moving capacity of the machine. Entering a stall condition, generally, is undesirable in any operating scenario; but stall occurring during automated operation of machines is especially harmful to smooth operations for automated work.

Additionally or alternatively, the dozer may get stuck because, with the existence of such bumps, a cut depth may be set near the bump. For each cut, the volume calculated for a pass should be less than or equal to a full blade. Therefore, even if the volume calculation is made after information is considered regarding the leftover bump, the dozer may get stuck from cutting too deep relative to the existing terrain, even if a lesser volume is expected.

Therefore, systems and methods for controlling operation of earthmoving machines, wherein pass depth can be adjusted based on materials above an expected height of a work surface, are desired.

SUMMARY

In accordance with one aspect of the disclosure, a method for controlling an earthmoving machine and a work implement associated with the earth moving machine, during an earthmoving operation on a work surface, is disclosed. The work surface may have an expected surface height, the earthmoving operation may include a pass, and the pass may have a target depth. The method may include receiving positioning signals from a positioning system associated with the earthmoving machine. The positioning signals may be indicative of a topography of the work surface. The method may further include determining a profile of the work surface based on the positioning signals and determining if the profile of the work surface includes a bump, the bump having a bump height which is greater than the expected surface height. The method may further include determining a depth adjustment based on the bump height and adjusting the target depth based on the depth adjustment, if the profile of the work surface includes the bump. In some example embodiments, the method may further include determining a discount factor based on one or more conditions associated with the earthmoving operation. In some such examples embodiments, determining the depth adjustment may be executed by multiplying the bump height by the discount factor.

In accordance with another aspect of the disclosure, a system for controlling an earthmoving machine and a work implement associated with the earthmoving machine, during an earthmoving operation on a work surface, is disclosed. The work surface may have an expected surface height, the earthmoving operation may include a pass, and the pass may have a target depth. The system may include a positioning system associated with the earthmoving machine, the positioning system generating positioning signals indicative of topography of the work surface. The system may further include a controller. The controller may be configured to receive the positioning signals, determine a profile of the work surface based on the positioning signals, determine if the profile of the work surface has a bump, the bump having a bump height which is greater than the expected surface height, determine a depth adjustment for the pass based on the bump height, and adjust the target depth based on the depth adjustment.

In accordance with yet another aspect of the disclosure, an earthmoving machine is disclosed. The earthmoving machine may include a prime mover and a work implement for cutting a work surface during an earthmoving operation. The earthmoving operation may include a pass having a target depth and the work surface may have an expected surface height. The earthmoving machine may further include a positioning system associated with the earthmoving machine, the positioning system generating positioning signals indicative of topography of the work surface. The earthmoving machine may further include a controller. The controller may be configured to receive the positioning signals, determine a profile of the work surface based on the positioning signals, determine if the profile of the work surface has a bump, the bump having a bump height which is greater than the expected surface height, determine a depth adjustment for the pass based on the bump height, and adjust the target depth based on the depth adjustment.

Other features and advantages of the disclosed systems and principles will become apparent from reading the following detailed disclosure in conjunction with the included drawing figures.

While the following detailed description will be given with respect to certain illustrative embodiments, it should be understood that the drawings are not necessarily to scale and the disclosed embodiments are sometimes illustrated diagrammatically and in partial views. In addition, in certain instances, details which are not necessary for an understanding of the disclosed subject matter or which render other details too difficult to perceive may have been omitted. It should therefore be understood that this disclosure is not limited to the particular embodiments disclosed and illustrated herein, but rather to a fair reading of the entire disclosure and claims, as well as any equivalents thereto.

DETAILED DESCRIPTION

Figure 1:
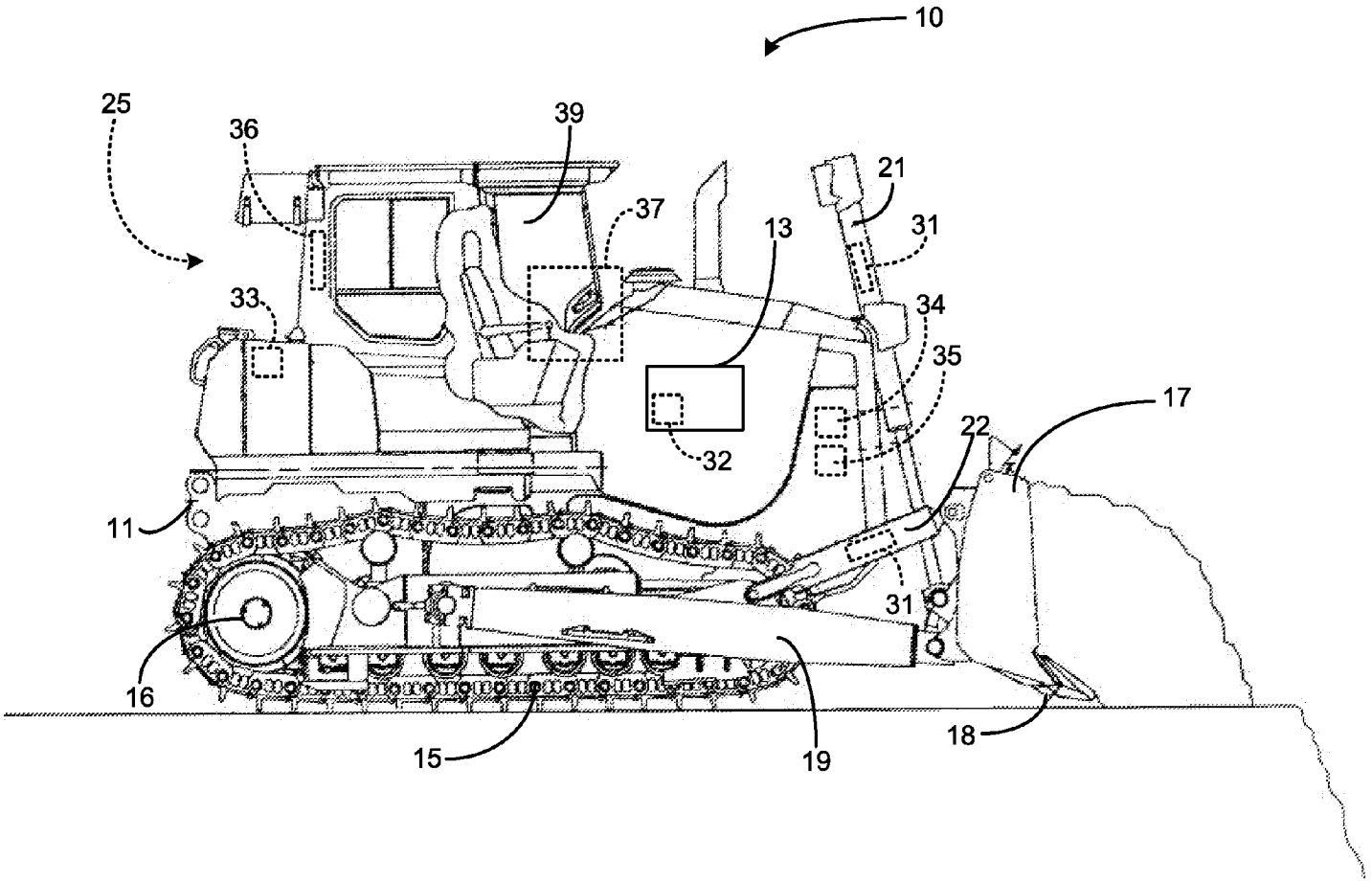
FIG. 1 is a side view of a machine having a control system, in accordance with an embodiment of the present disclosure.

Turning now to the drawings and with specific reference to FIG. 1, an earthmoving machine 10 is shown. In the illustrated embodiment, the machine 10 is shown as a bulldozer; however, the machine 10 is not limited to being a bulldozer, but may be any earth moving machine that is configured to move materials on a worksite. Worksites on which the machine 10 may move materials include, but are not limited to including, a mining site, a landfill, a quarry, a construction site, or any other area in which movement of material is desired. The machine 10, and its respective elements detailed below, may be employed at a worksite for a variety of earth moving operations, such as dozing, grading, leveling, bulk material removal, or any other type of operation that results in alteration of topography of the worksite.

Generally, the machine 10 includes a frame 11 and a prime mover, such as an engine 13. A track 15 is included as a ground-engaging drive mechanism and the track 15 is driven by a drive wheel 16 on each side of the machine 10 to propel the machine 10. While the machine 10 is shown having the track 15 and is, generally, a "track-type" machine, other ground-engaging mechanisms are certainly possible (e.g., tires in a wheeled configuration).

For earthmoving, the machine 10 may employ a work implement, such as the blade 17, to push or otherwise move materials at a worksite. During earth moving functions, the blade 17 may initially engage the worksite with a blade tip 18 of the blade 17. The blade 17 may be pivotally connected to the frame 11 by arms 19 on each side of the machine 10. One or more first hydraulic cylinders 21 may be coupled to the frame 11 to support the blade 17 in the vertical direction and allow the blade 17 to move up or down vertically. Additionally, one or more second hydraulic cylinders 22 may be included on each side of the machine 10 to allow the pitch angle of the blade tip 18 to change relative to a centerline (not shown) of the machine 10. The hydraulic cylinders 21, 22 may be actuators that receive actuation instructions, from a control system 25, to adjust, lift, lower, or otherwise move and/or position the blade 17.

Figure 2:
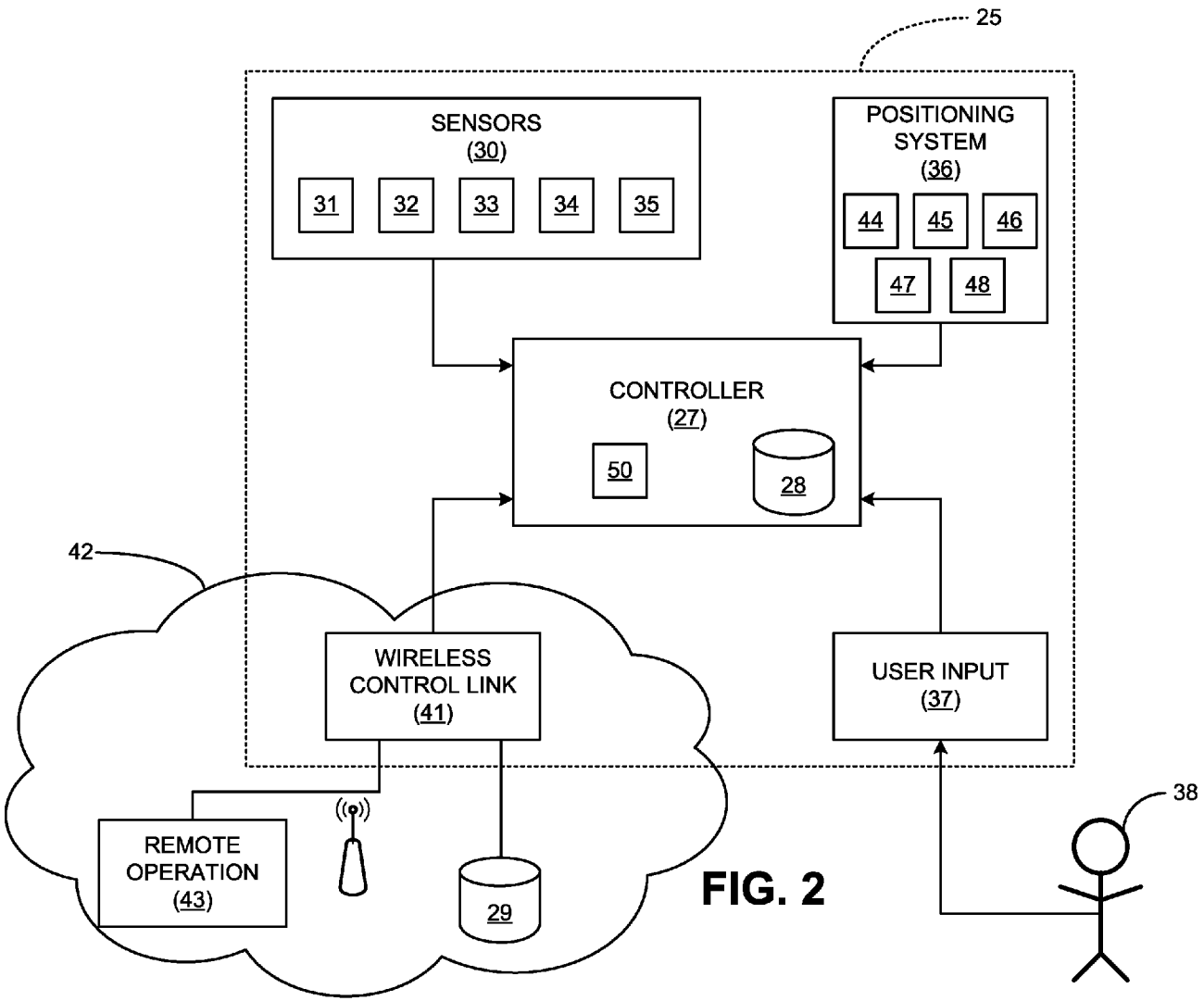
FIG. 2 is a schematic diagram of the control system of FIG. 1, in accordance with the embodiment of FIG. 1.

However, the control system 25 is not limited to only controlling the hydraulic cylinders 21, 22 to move the implement, the control system 25 may be utilized for controlling any operations of the machine 10. Referring now to FIG. 2 and with continued reference to FIG. 1, a schematic diagram of the control system 25 is shown. While the connections between elements of the control system 25 are best shown in the schematic view of FIG. 2, some elements are also represented in FIG. 1 and denoted, schematically, by boxes having dotted lines. The control system 25 may be used to control the machine 10 in a variety of autonomous, semi-autonomous, or manual modes. As used herein, a machine 10 operating in an autonomous manner operates automatically based upon information received from various sensors, without the need for human operator input. Further, a machine 10 operating semi-autonomously includes an operator, either within the machine 10 or remotely, who performs some tasks or provides some input while other tasks are performed automatically based upon information received from various sensors. A machine 10 being operated manually is one in which an operator is controlling all or essentially all of the direction, speed and manipulating functions of the machine 10. A machine may be operated remotely by an operator (e.g., remote control) in either a manual or semi-autonomous manner.

Operation of the machine 10, in any of the above referenced manners, may be executed by a controller 27. The controller 27 may be any electronic controller or computing system including a processor which operates to perform operations, executes control algorithms, stores data, retrieves data, gathers data, and/or performs any other computing or controlling task desired. The controller 27 may be a single controller or may include more than one controller disposed to control various functions and/or features of the machine 10. Functionality of the controller 27 may be implemented in hardware and/or software and may rely on one or more data maps relating to the operation of the machine 10. To that end, the controller 27 may include internal memory 28 and/or the controller 27 may be otherwise connected to external memory 29, such as a database or server. The internal memory 28 and/or external memory 29 may include, but are not limited to including, one or more of read only memory (ROM), random access memory (RAM), a portable memory, and the like. Such memory media are examples of nontransitory memory media.

For determining characteristics associated with the machine 10, the controller 27 may be operatively associated with one or more machine sensors 30. The term "sensor" is used in its broadest sense to include one or more sensors and related components that may be associated with the machine 10 and that may operate to sense functions, operations, and/or operating characteristics of the machine. The machine sensors 30 may provide data, either directly or indirectly, which is indicative of various parameters and conditions associated with the machine 10. As shown, the machine sensors 30 include hydraulic pressure sensor(s) 31, engine speed sensor(s) 32, accelerometer(s) 33, pitch angle sensor(s) 34, and pitch rate sensor(s) 35. Further, the machine sensors 30 are not limited to including the referenced sensors and may include any other sensors useful for providing information associated with conditions of the machine 10 to the controller 27.

In the example control system 25, hydraulic pressure sensors 31 are shown which may be associated with one or more of the first hydraulic cylinders 21 and/or the second hydraulic cylinders 22. The hydraulic pressure information obtained by the hydraulic pressure sensors 31 may be useful in determining and/or controlling positions of the blade 17. Further, the engine speed sensor 32 may be used to determine conditions associated with the engine 13. The accelerometer 33 is useful for determining acceleration of the machine 10 along various axes of operation. The pitch angle sensor 34 and pitch rate sensor 35 are useful for determining any roll, pitch, or yaw of the machine 10.

The control system 25 may also include a positioning system 36 for monitoring and/or controlling movement of the machine 10, which may include, for example a global positioning system ("GPS"). The positioning system 36 may sense the position of the machine 10 relative to an associated work area. The positioning system 36 may include a plurality of individual sensors that cooperate to provide signals to the controller 27 to indicate the position of the machine 10 and/or map characteristics of a work surface, such as topography of the work surface. Using the positioning system 36, the controller may determine the position of the machine 10 within the work area as well as determine the orientation of the machine, such as its heading, pitch, and roll. With said information, dimensions of the machine 10 and/or an associated work site may be stored by the control system 25 with the positioning system 36 defining a datum or reference point on the machine and the controller using the dimensions to determine a position of the terrain or work surface upon which the machine is operating.

User input 37 may be included with the control system 25 so that an operator (not shown) may have the ability to operate the machine. For example, user input 37 may be provided in a cab 39 of the machine 10, wherein the operator may provide commands when the machine 10 is operating in either a manual or semi-autonomous manner. The user input 37 may include one or more input devices through which the operator may issue commands to control the propulsion and steering of the machine 10 as well as operate various implements associated with the machine 10.

Additionally or alternatively, the control system 25 may include a wireless control link 41 which is connected to a wireless network 42. Via the wireless control link 41, commands may be given to the machine 10 via the controller 27 from a remote operation 43 (e.g., a command center, a foreman's station, and the like). Further, information may be accessed from and/or stored to the external memory 29. In certain embodiments, control of the machine 10 via the control system 25 may be distributed such that certain functions are performed at the machine 10 and other functions are performed via remote operation 43.

As mentioned above, the positioning system 36 may be employed to determine an actual profile of a work surface to be used in a work plan. The positioning system may include one or more GPS sensors 44 for detecting locations of the machine 10 or one or more elements of the machine 10 relative to the worksite. Other elements of the positioning system 36 may include, but are not limited to including, odometers 45, wheel rotation sensing sensors 46, perception based system sensors 47, and laser position detection systems 48. All elements of the positioning system may be used to determine the real time actual profile of the work surface to be used for analysis by the control system 25. Of course, other elements aiding in detecting positioning of the machine 10 or the worksite may be included and input from the machine sensors 30 may also be used in determining the actual profile of the work surface.

Using data provided by, at least, one or more of the elements of the positioning system 36, the control system 25 may be configured to implement a material movement plan 50. The material movement plan may be instructions stored on at least one of the internal memory 28 and/or the external memory 29 and executed by the controller 27. The material movement plan 50 may be influenced by elements of the control system 25, such as input from any of the sensors 30, the positioning system 36, the user input 37, the remote operation 43, or any other conditions or controls associated with the machine 10. The material movement plan 50 may include one or more passes for a ground moving operation and may provide plans for cut locations based on the one or more passes.

Figure 3:
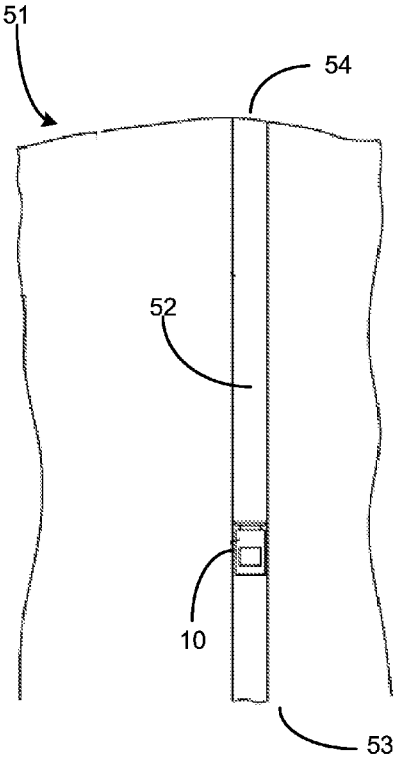
FIG. 3 is an overhead view of an example worksite on which an earthmoving operation may be performed by the machine of FIG. 1 when utilizing the control system of FIGS. 1 and 2.

As shown, generally, in FIG. 3, the machine 10 may operate at a worksite 51 to move material to create a slot 52. The slot may begin at an initial location 53 and end at a spread location 54. The machine 10 may be configured to move material at the worksite 51 according to the material movement plan 50. The material movement plan 50 may provide specific instructions for specific cuts involved in moving material to the spread location 54.

Figure 4:
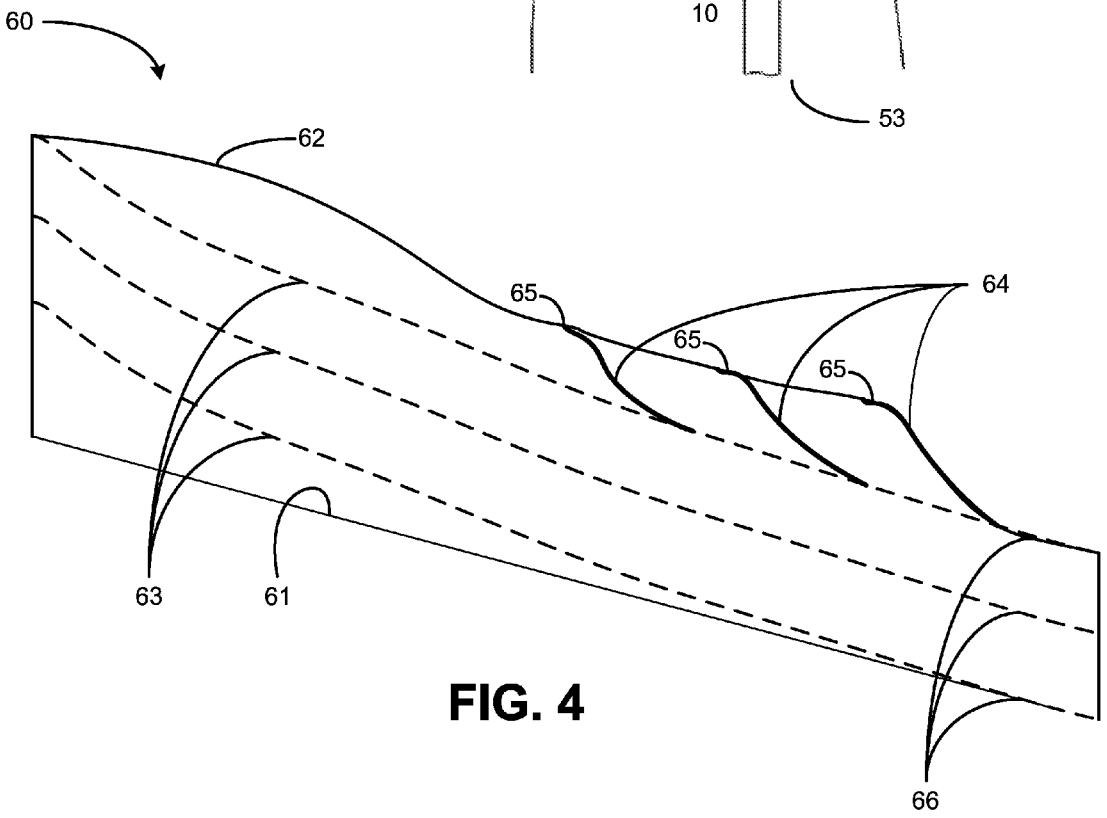
FIG. 4 is a cross section of an example work surface at a work site depicting various aspects of an example material moving plan of an earthmoving operation.

For purposes of explanation, FIG. 4 shows a cross section of an example work plan 60 for an earthmoving operation. The earthmoving operation may be performed using the work plan 60 by initially setting the desired parameters of the final work surface or final design plane 61. Material may be removed from a top work surface 62 in one or more passes 63 until the final design plane 61 is reached. The blade 17 of the machine 10 may engage the work surface 62 with a series of cuts 64 that are spaced out lengthwise along the work surface 62. Each cut 64 begins at a cut location 65 along the work surface 62, at which the blade 17 initially engages the work surface and extends into the moved material toward a spread location 66 for each particular pass. The control system 25 may be configured to guide the blade 17 along each cut 64 until reaching the spread location 66 then follow the spread location 66 towards a downstream dump location.

Figure 5:
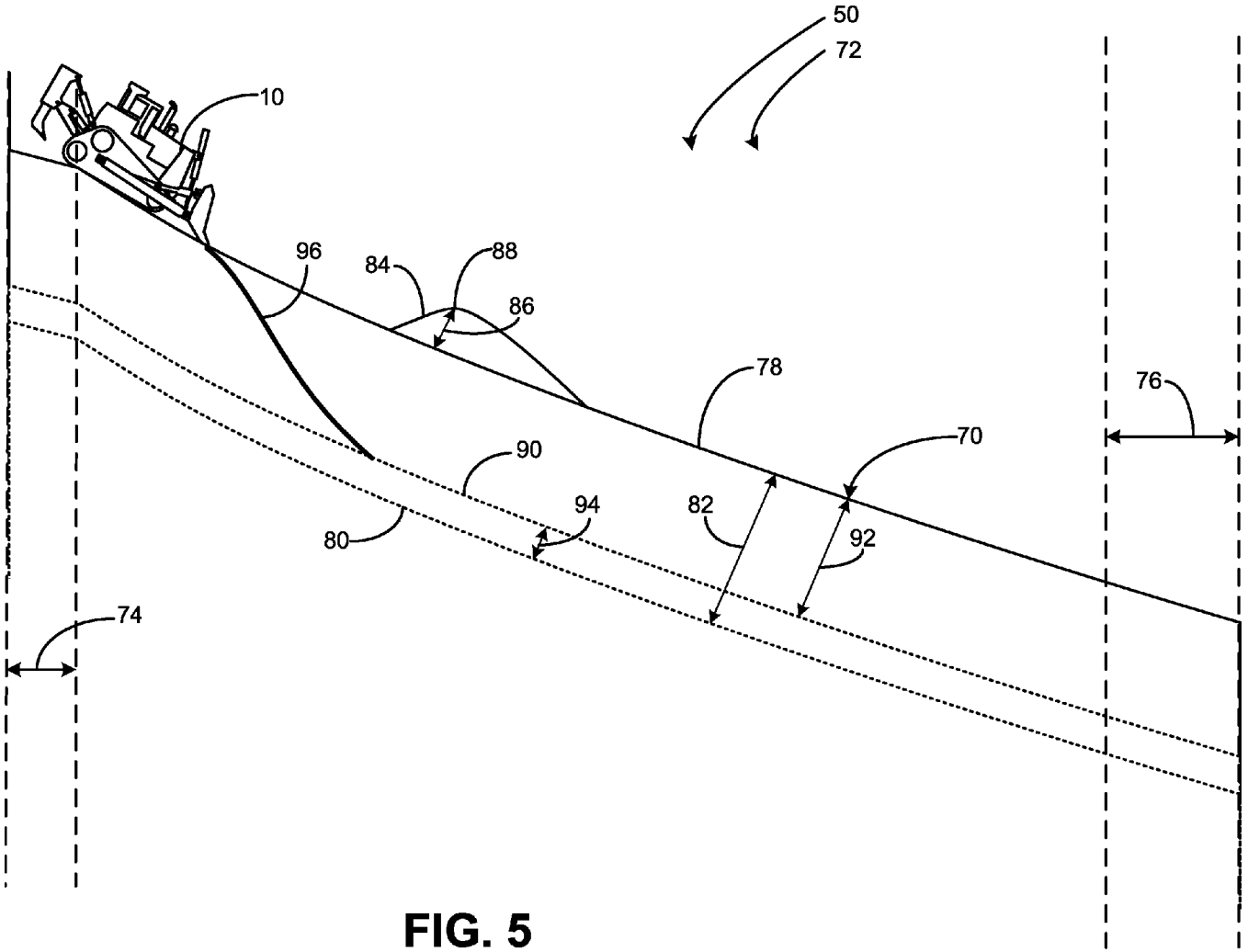
FIG. 5 is a cross section of an example work surface at a work site depicting various aspects of a material moving plan for an example earthmoving operation, in accordance with the present disclosure.

Turning now to FIG. 5, the material movement plan 50, for execution by the controller 27 for an earthmoving operation on a work surface 70, is shown. The material movement plan 50 may be configured based on signals from the positioning system 36 and, as shown, is configured based upon topography 72 of the work surface 70, as determined from the positioning signals. The machine 10 would begin operation in accordance with the material movement plan 50 at the initial location 74 (e.g., an align gap) and conclude passes of a material movement operation by moving said materials to a spread location 76. The topography for the material movement plan 50 has an expected surface height 78. Of course, because the topography 72 is not necessarily a level surface, the expected surface height 78 may not be constant and may rise or lower along the course of the work surface 70.

The material movement plan 50 may include directions for an initial pass 80, based on the topography 72 and, particularly, characteristics of the expected surface height 78. The initial pass 80 has a target depth 82 from the expected surface height 78. As with the expected surface height 78, the target depth 82 may rise or lower with the course of the work surface 70, as the work surface 70 is not necessarily a level surface. However, as shown in FIG. 5, the topography 72 skews from the expected surface height 78 due to the presence of a bump 84 having a bump height 86, the bump height 86 being measured from the expected surface height 78 to a tallest point 88 of the bump 84, relative to the expected surface height 78. As used herein, "bump" 84 is understood to mean any elevation change in the surface 70.

Due to the presence of the bump 84, the initial pass 80 may include excessive materials and the machine 10 may not be capable of moving all of the materials which would, prospectively, be moved during the initial pass 80. If the machine 10 cannot handle the weight or volume of materials to be pushed during the initial pass 80, the machine 10 may stall or otherwise become unable to complete the initial pass 80 of the material movement plan 50. Therefore, the controller 27 may determine an adjusted pass 90 having an adjusted depth 92 to prevent stall or inability to complete the material movement plan 50. As with both the expected surface height 78 and the target depth 82, the adjusted depth 92 may raise or lower with the course of the work surface 70, as the work surface 70 is not necessarily a level surface. The adjusted pass 90 may be determined by adjusting the initial pass based on a depth adjustment 94. While, the depth adjustment 94 is shown in FIG. 5 as applied with a consistent depth along the course of the initial pass 80, the depth adjustment 94 does not need to be constant and may vary over the course of the adjusted pass 90 along the work surface 70.

Figure 6:
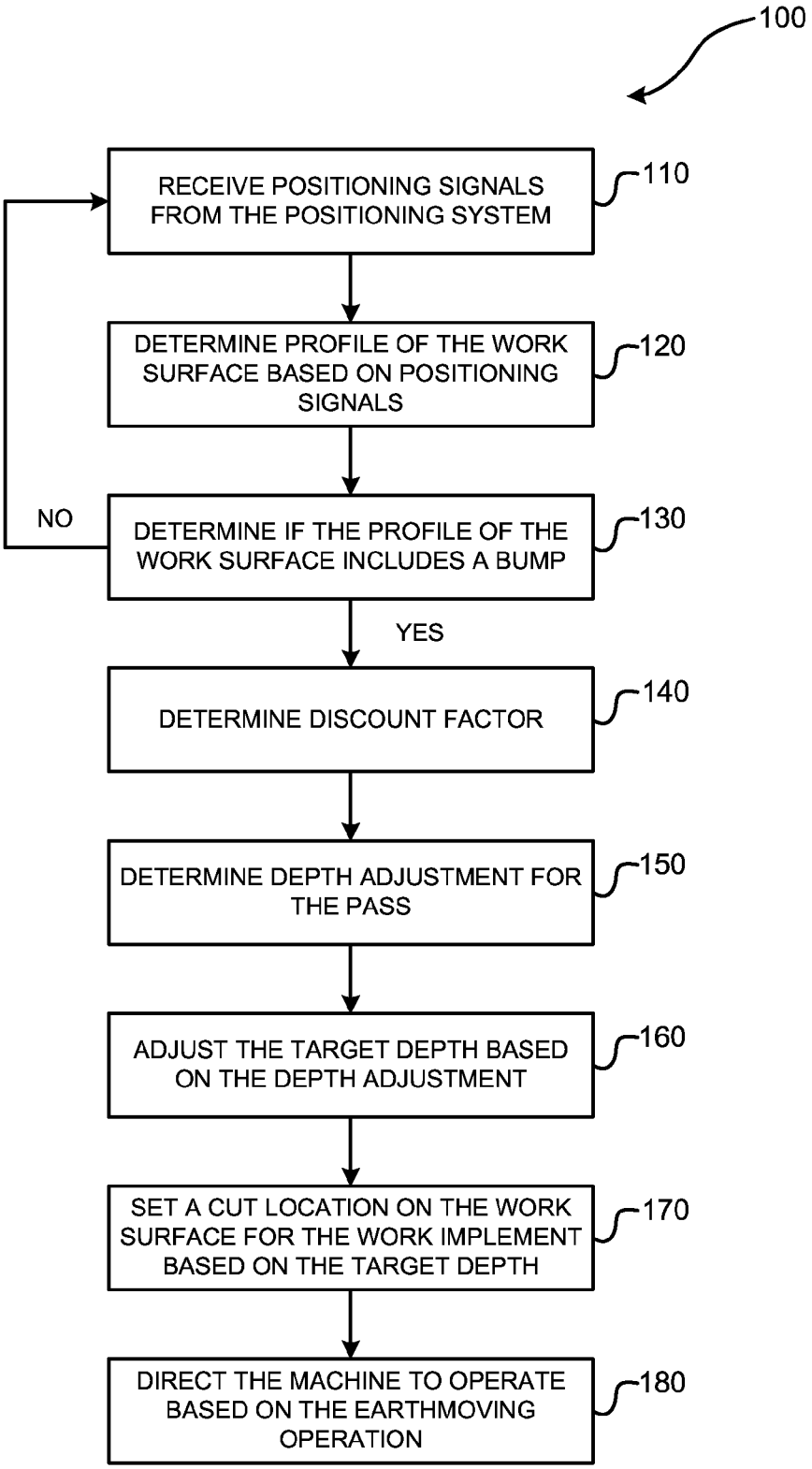
FIG. 6 is a flowchart illustrating a method for controlling an earthmoving machine during an earthmoving process in accordance with the present disclosure.

To control the planning of one or more cut locations 96 based on the initial pass 80 and/or the adjusted pass 90, the control system 25 may implement the method 100 of FIG. 6, which may be implemented as part of, for example, the material movement plan 50. The method 100 may be instructions stored on at least one of the internal memory and/or the external memory 29 and executed by the controller 27. Further, the method 100 may be implemented remotely by the remote operation 43 in conjunction with the wireless control link 41 and controller 27. The method 100 is not limited to being executed by the above mentioned elements of the control system 25 and may be implemented using any combination of autonomous, semi-autonomous, and/or manual controls.

The method 100 may be employed to execute an earthmoving operation, such as the material movement plan 50, which may include the initial pass 80. The method 100 begins at block 110, when the controller 27 receives positioning signals associated with the machine 10 and/or the work surface 70 from the positioning system 36. The controller 27 may then determine an actual profile of the work surface 70, such as the topography 72, as shown in block 120. The topography 72 may include any characteristics of the work surface 70, such as the expected surface height 78. At block 130, the topography 72 may be analyzed, either manually or automatically, to determine if the bump 84 exists, the bump 84 having a bump height 86 that is greater than the expected surface height 78 at a respective location along the work surface 70. If the bump 84 is not present on the topography 72, then the method 100 returns to block 110 and continues to receive positioning signals from the positioning system 36 to monitor the topography 72.

However, if the topography 72 includes the bump 84, like in the example of FIG. 5, then the method 100 continues to block 140, where a discount factor, for use in determining a depth adjustment for the initial pass 80, may be determined. The discount factor may be based on one or more conditions associated with the earthmoving operation, such as performance capabilities of the earthmoving machine 10, topographical conditions of the work surface 70, and/or conditions associated with the materials moved at the work surface 70. For example, performance capabilities of the earthmoving machine 10 may include maximum power output available from the engine 13, traction characteristics of the track 15, weight of the machine 10 or other gravitational effects, and the like. Further, examples of topographical conditions may include curvature of the work surface 70, grade of the work surface 70, slope of the work surface 70, and the like. Conditions associated with the materials moved at the work surface 70 may include, but are not limited to including, soil properties when soil is moved at the work surface 70.

The discount factor may be a factor or coefficient determined based on any information associated with the earthmoving operation and may be used, in conjunction with the bump height 86, to determine the depth adjustment 94 based on the bump height 86 (block 150). In some examples, the depth adjustment 94 may be determined by multiplying the discount factor by the bump height 86. However, determining the depth adjustment 94 does not require the discount factor, but the discount factor may be used for optimization of the depth adjustment 94. Of course, other data and/or conditions may be considered and/or used in calculating the depth adjustment 94.

At block 160, the determined depth adjustment 94 is then used to adjust the target depth 82 used for the initial pass 80 to determine adjusted depth 92 for generating course for the adjusted pass 90. In some examples wherein the depth adjustment 94 is determined by multiplying the bump height 86 by the discount factor, the adjusted depth 92 is determined by subtracting the depth adjustment from the target depth 82. Once the adjusted pass 90 is determined, the method 100 may continue by setting the cut location 96 for the blade 17 of the machine 10, based on the adjusted pass 90, as shown in block 170. With the cut location 96 set, the method 100 may continue by directing the machine 10 to execute the material movement plan 50 based on the adjusted pass 90, as determined, which is shown in block 180.

INDUSTRIAL APPLICABILITY

The present disclosure relates generally to control systems for earthmoving machines and, more specifically, to systems and methods for controlling earthmoving machines to adjust depth of passes based on the presence of excess materials above an expected height of a work surface. The foregoing is applicable to earthmoving machines, such as the machine 10, operating at worksites that include, but are not limited to including, a mining site, a landfill, a quarry, a construction site, or any other area in which movement of material is desired. The disclosed systems and methods may be useful in avoiding rework at the worksite by optimizing cut locations on the worksite based on the sensed topography which shows existence of and dimensions of excess materials above an expected height of materials on a worksite. The systems and methods disclosed may be especially useful in avoiding scenarios in which the machine 10 becomes inoperable or enters a stall condition because the weight and/or volume of materials to be moved is beyond the capacity of the machine 10. Further, the systems and methods may be useful in correcting overly deep cuts determined when a bump is detected.

The manner of operation of the systems and methods and various parameters thereof may be set by an operator, management of the worksite, or other personnel as desired. Such operation may be employed by a controller and received remotely or on-board the machine.

It will be appreciated that the present disclosure provides a systems and methods for controlling an earthmoving machine and an earthmoving machine. While only certain embodiments have been set forth, alternatives and modifications will be apparent from the above description to those skilled in the art. These and other alternatives are considered equivalents and within the spirit and scope of this disclosure and the appended claims.

What is claimed is:

1. A method for controlling an earthmoving machine and a work implement associated with the earthmoving machine during an earthmoving operation of a work plan, the work plan including a projected first pass to create a projected work surface and a projected second pass having a target depth, the projected work surface having an expected surface height, the earthmoving machine including a prime mover, a ground engaging-mechanism, and a machine weight, the method comprising:

performing an actual first pass and creating an actual work surface;

receiving, with a controller, positioning signals from a positioning system associated with the earthmoving machine during the actual first pass, the positioning signals indicative of a topography of the actual work surface;

determining, with the controller, a profile of the actual work surface based at least in part on the positioning signals;

determining, with the controller, if the profile of the actual work surface includes a bump, the bump having a bump height, the bump height being greater than the expected surface height;

determining, with the controller, a depth adjustment if the profile of the actual work surface includes the bump, the depth adjustment based, at least in part, on the bump height and performance characteristics of the earthmoving machine, the performance characteristics of the earth moving machine including at least one of a maximum power output of the prime mover, a traction characteristic of the ground engaging-mechanism, and the machine weight; and determining, with the controller, an adjusted projected second pass at least in part by adjusting the target depth based on the depth adjustment, if the profile of the actual work surface includes the bump.

2. The method of claim 1, further comprising setting a cut location, with the controller, on the actual work surface for the work implement for the adjusted projected second pass, the cut location based at least in part on the target depth.

3. The method of claim 2, further comprising performing an actual second pass with the earthmoving machine, wherein the actual second pass is performed based on the adjusted projected second pass, if the profile of the actual work surface includes the bump.

4. The method of claim 1, further comprising determining, with the controller, a discount factor based on one or more conditions associated with the earthmoving operation.

5. The method of claim 4, wherein determining the depth adjustment, if the profile of the actual work surface includes the bump, further includes determining the depth adjustment based on the bump height and the discount factor.

6. The method of claim 5, wherein determining the depth adjustment based on the bump height and the discount factor is executed by multiplying the bump height by the discount factor, with the controller.

7. The method of claim 6, wherein adjusting the target depth based on the depth adjustment, if the profile of the actual work surface includes the bump includes replacing the target depth with an adjusted target depth, the adjusted target depth determined by subtracting the depth adjustment from the target depth.

8. The method of claim 4, wherein determining a discount factor based on one or more conditions associated with the earthmoving operation includes that the one or more conditions associated with the earthmoving operation include at least one of a performance capability of the earthmoving machine, a topographical condition of the actual work surface, or a condition associated with a material of the actual work surface.

9. A system for controlling an earthmoving machine and a work implement associated with the earthmoving machine during an earthmoving operation of a work plan, the work plan including a projected first pass to create a projected work surface and a projected second pass having a target depth, the projected work surface having an expected surface height, the earthmoving machine including a prime mover, a ground engaging-mechanism, and a machine weight, the system comprising:

a positioning system associated with the earthmoving machine, the positioning system configured to generate positioning signals during an actual first pass, the positioning signals indicative of a topography of an actual work surface created by the actual first pass; and a controller configured to execute instructions to:

receive the positioning signals;

determine a profile of the actual work surface based on the positioning signals;

determine if the profile of the actual work surface includes a bump, the bump having a bump height, the bump height being greater than the expected surface height;

determine a depth adjustment if the profile of the actual work surface includes the bump, the depth adjustment based, at least in part, on the bump height and performance characteristics of the earthmoving machine, the performance characteristics of the earth moving machine including at least one of a maximum power output of the prime mover, a traction characteristic of the ground engaging-mechanism, and the machine weight; and determine an adjusted projected second pass at least in part by adjusting the target depth based on the depth adjustment if the profile of the actual work surface includes the bump.

10. The system of claim 9, wherein the controller is further configured to execute instructions to set a cut location on the actual work surface for the work implement for the adjusted projected second pass, the cut location based on the target depth.

11. The system of claim 10, further comprising one or more actuators, wherein the controller is further configured to send signals to the actuators to direct the earthmoving machine to operate the earthmoving machine based on the work plan, and wherein the work plan includes the adjusted projected second pass.

12. The system of claim 9, wherein the controller is further configured to determine a discount factor based on one or more conditions associated with the earthmoving operation.

13. The system of claim 12, further comprising one or more machine sensors associated with the machine for generating machine sensor signals, and wherein the controller is further configured to:

receive the machine sensor signals; and determine at least one of the one or more conditions associated with the earthmoving operation based on the machine sensor signals.

14. The system of claim 12, wherein the one or more conditions associated with the earthmoving operation includes that the one or more conditions associated with the earthmoving operation include at least one of a performance capability of the earthmoving machine, a topographical condition of the actual work surface, or a condition associated with a material of the actual work surface.

15. The system of claim 14, wherein the performance capability of the earthmoving machine is a drive power capability of the earthmoving machine.

16. The system of claim 12, wherein the controller determines the depth adjustment based on the bump height and the discount factor.

17. An earthmoving machine, comprising:

a prime mover;

a ground engaging mechanism;

a machine weight a work implement for cutting a work surface during an earthmoving operation of a work plan;

a positioning system associated with the earthmoving machine, the positioning system configured to generate positioning signals during an actual first pass, the positioning signals indicative of a topography of an actual work surface created by the actual first pass; and; and a controller including a memory component including the work plan, the work plan including a projected first pass to create a projected work surface, and a projected second pass having a target depth, the projected work surface having an expected surface height, wherein the controller is configured to execute instructions to:

receive the positioning signals;

determine a profile of the actual work surface based on the positioning signals;

determine if the profile of the actual work surface includes a bump, the bump having a bump height, the bump height being greater than the expected surface height;

determine a depth adjustment if the profile of the actual work surface includes the bump, the depth adjustment based, at least in part, on the bump height and performance characteristics of the earthmoving machine, the performance characteristics of the earth moving machine including at least one of a maximum power output of the prime mover, a traction characteristic of the ground-engaging mechanism, and the machine weight; and determine an adjusted projected second pass at least in part by adjusting the target depth based on the depth adjustment if the profile of the actual work surface includes the bump.

18. The earthmoving machine of claim 17, wherein the controller is further configured to execute instructions to set a cut location on the actual work surface for the work implement for the adjusted projected second pass, the cut location based on the target depth.

19. The earthmoving machine of claim 18, further comprising one or more actuators, wherein the controller is further configured to send signals to the actuators to direct the earthmoving machine to operate the earthmoving machine based on the work plan, and wherein the work plan includes the adjusted projected second pass.

20. The earthmoving machine of claim 17, wherein the controller is further configured to determine a discount factor based on one or more conditions associated with the earthmoving operation, and wherein the controller determines the depth adjustment based on the bump height and the discount factor.

* * * * *